US010941599B2

(12) United States Patent
Kunz

(10) Patent No.: US 10,941,599 B2
(45) Date of Patent: Mar. 9, 2021

(54) MOUNTING SYSTEM FOR MOUNTING A COIL SPRING TO A WINDOW FRAME IN A SASH COUNTERBALANCE SYSTEM

(71) Applicant: John Evans' Sons, Inc., Lansdale, PA (US)

(72) Inventor: John R. Kunz, Douglassville, PA (US)

(73) Assignee: John Evans' Sons, Inc., Lansdale, PA (US)

( * ) Notice: Subject to any disclaimer, the term of this patent is extended or adjusted under 35 U.S.C. 154(b) by 154 days.

(21) Appl. No.: 16/152,006

(22) Filed: Oct. 4, 2018

(65) Prior Publication Data

US 2020/0109584 A1 Apr. 9, 2020

(51) Int. Cl.
*E05D 13/00* (2006.01)

(52) U.S. Cl.
CPC .... *E05D 13/1276* (2013.01); *E05Y 2900/148* (2013.01)

(58) Field of Classification Search
CPC ..... E05D 13/1276
See application file for complete search history.

(56) References Cited

U.S. PATENT DOCUMENTS 2,609,193 A * 9/1952 Foster ..... E05D 13/1292 267/156
2,702,402 A * 2/1955 Haas ..... E05D 13/1276 16/198
2,732,594 A 1/1956 Adams et al.
3,160,914 A 12/1964 Brienza
3,475,865 A * 11/1969 Arnes ..... E05D 13/1276 49/445
3,869,754 A * 3/1975 Foster ..... E05D 13/1276 16/197
4,953,258 A * 9/1990 Mennuto ..... E05D 13/1276 16/193
5,232,208 A 8/1993 Braid et al.
6,378,169 B1 * 4/2002 Batten ..... E05D 13/1276 16/197
6,584,644 B2 * 7/2003 Braid ..... E05D 13/1276 16/197
6,857,228 B2 * 2/2005 Kunz ..... E05D 13/08 16/197
6,934,998 B1 8/2005 Shuler
6,983,513 B2 * 1/2006 Pettit ..... E05D 13/08 16/197

(Continued)

FOREIGN PATENT DOCUMENTS

JP 05133153 A 5/1993

*Primary Examiner* — Catherine A Kelly
(74) *Attorney, Agent, or Firm* — LaMorte & Associates P.C.

(57) ABSTRACT

An anchoring system used to anchor a ribbon spring to a guide track. A mounting slot is formed in the guide track that provides access to the internal gap space. A counterbalance spring is provided having an offset tab section proximate a free end. A barb flap is formed by bending a segment of the counterbalance spring from the offset tab section. The offset tab section with barb flap are extended into the gap space through the mounting slot. As the counterbalance spring is unwound, a bias is created that engages both the offset tab section and the barb flap within the gap space. This locks the free end of the counterbalance spring in place without the need of any mechanical fastener.

13 Claims, 6 Drawing Sheets

(56) References Cited

U.S. PATENT DOCUMENTS

| | | | | |
|---|---|---|---|---|
| 7,980,028 | B1 | 7/2011 | Kunz | |
| 8,181,396 | B1 * | 5/2012 | Kunz | E05D 13/1276 16/197 |
| 9,115,522 | B2 * | 8/2015 | Sofianek | E05D 13/1276 |
| 9,458,655 | B2 * | 10/2016 | deNormand | E05D 15/22 |
| 10,053,899 | B2 * | 8/2018 | deNormand | E05D 15/165 |
| 10,081,972 | B1 * | 9/2018 | Kunz | E05D 13/1276 |
| 10,174,537 | B1 * | 1/2019 | Kunz | E05D 13/1253 |
| 10,415,287 | B1 * | 9/2019 | Kunz | E05F 5/003 |
| 2002/0116786 | A1 | 8/2002 | Guillemet et al. | |
| 2004/0206003 | A1 * | 10/2004 | Kunz | E05D 13/08 49/181 |
| 2005/0198775 | A1 | 9/2005 | Pettit et al. | |

* cited by examiner

MOUNTING SYSTEM FOR MOUNTING A COIL SPRING TO A WINDOW FRAME IN A SASH COUNTERBALANCE SYSTEM

BACKGROUND OF THE INVENTION

1. Field of the Invention

In general, the present invention relates to counterbalance systems for windows that prevent open window sashes from closing under the force of their own weight. More particularly, the present invention system relates to the structure of coil springs used in such counterbalance systems and the mechanism used to anchor the coil springs to the window frame.

2. Description of the Prior Art

There are many types of windows that are used in modern construction. Some windows are designed to open, some are not. Of the windows that are designed to open, some windows have sashes that open vertically and others have sashes that slide open laterally or rotate outwardly.

Windows that have vertically opening sashes are the most common window used in residential home construction. Vertically opening windows are either single-hung, having one sash that opens, or double-hung, having two sashes that open. In both single-hung and double-hung windows, a counterbalance system is used to hold a window sash in place once it is opened. If no counterbalance system is used, gravity will cause the sash of the window to close as soon as it is opened and released. Early window sash counterbalance systems were simply weights that were attached to the sash. The weights were attached to a sash by a rope or chain that passed over a pulley at the top of the window frame. Such counterbalance systems required window wells in which the weights moved. Accordingly, such windows were difficult to insulate. Additionally, the rough opening needed for the window had to be much larger than the window sashes. Additionally, window sashes attached to such counterbalance systems could not be tilted for cleaning or otherwise removed from the window frame.

Recognizing the many disadvantages of window well counterbalance systems, windows were manufactured with spring loaded counterbalance systems. Spring loaded counterbalance systems relied upon the pulling strength of a spring, rather than a hanging weight, in order to counterbalance the weight of a window sash. Accordingly, window wells for weights were no longer required.

Counterbalancing a window sash with a coil spring is a fairly simple matter. One end of the coil spring is attached to the window frame while the body of the coil spring is engaged by the sash. One of the simplest examples of a coil spring counterbalance system is shown in U.S. Pat. No. 2,732,594 to Adams, entitled Double Hung Window Sash.

In coil spring counterbalance systems, at least one coil spring is used on each side of a window sash. Multiple coil springs are used on windows with heavy sashes. The coil springs provide the counterbalance force to the window sashes needed to maintain the sashes in place. In order for the coil springs to resist the weight of a window sash, one end of the spring coil must be anchored to a stationary point along the window frame. In this manner, the coil spring winds and unwinds as a window sash is opened and closed. In the prior art, coil springs are typically anchored to the window frame using a screw or using an anchor block that is screwed in place. Both techniques have disadvantages. If a coil spring is attached to the window frame directly with a screw, the coil spring must be partially unwound in order to provide an accessible segment of the coil spring for attachment. This means that the coil spring must be physically manipulated while a screw is driven through the coil spring and into the window frame. Partially unwinding a strong coil spring while driving a screw through the coil spring is a complicated maneuver that can only be performed by hand. Consequently, the use of an anchor screw adds significantly to the labor and costs associated with the manufacture of the window. Furthermore, screw anchors tend to loosen over time. If the screw anchor loosens and protrudes, the screw can interfere with the movement of the window sashes. If the screw pulls loose, the coil spring is released and fails to function.

Anchor blocks are more reliable than anchor screws. However, anchor blocks protrude into the guide track of the window frame. Anchor blocks, therefore, present an obstruction in the window frame that may inhibit a window sash from fully opening.

In U.S. Pat. No. 8,181,396 to Kunz, an alternate anchoring system for a counterbalance spring is shown. In the Kunz system, a slot is formed in the wall of the window frame. The end of a counterbalance spring is bent into a certain configuration that enables the end of the spring to hook into the slot and mechanically engage the window frame. The system works well as long as the counterbalance spring is in tension. However, times do occur when there is little or no tension in the coil spring. These times occur during the manufacturing of the window and when a sash of the window is removed for cleaning, repair or replacement. Such a time also occurs when the window sash is opened with force, so that the speed of the opening window is greater than the speed at which the counterbalance spring can rewind. In such a scenario, it is possible for the counterbalance spring to experience compression. If this happens, the end of the coil spring can disengage from the slot in which it rests.

A need therefore exists for a counterbalance system that has an improved spring anchor mounting system that is reliable and is less likely to accidentally disengage when a counterbalance spring is not in tension. This need is met by the present invention as described and claimed below.

SUMMARY OF THE INVENTION

The present invention is the anchoring system used to anchor a ribbon spring to a guide track in a counterbalance system of window. The window has a window frame with a guide track. The guide track is defined in part by a first exterior wall. Due to its extruded construction, a second interior wall is disposed within the window frame. The interior wall and the exterior wall are separated by an internal gap space. A mounting slot is formed in the exterior wall that provides access to the internal gap space.

A counterbalance spring is provided that is wound into a coil. The counterbalance spring terminates with a free end. The counterbalance spring is bent into an anchor configuration proximate the free end. The anchor configuration includes a first bend in the counterbalance spring and a second bend in the counterbalance spring that defines a lateral section therebetween. The bends in the counterbalance spring also create an offset tab section of the counterbalance spring that extends from the second bend to the free end.

A barb flap is formed by bending a segment of the counterbalance spring from the offset tab section. The barb flap is angled so that it can easily pass through the mounting slot in only one direction. The offset tab section with barb flap are extended into the gap space through the mounting slot. The lateral section of the counterbalance spring remains in the mounting slot. As the counterbalance spring is unwound, a bias is created that engages both the offset tab section and the barb flap within the gap space. This locks the free end of the counterbalance spring in place without the need of any mechanical fastener.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Figure 1:
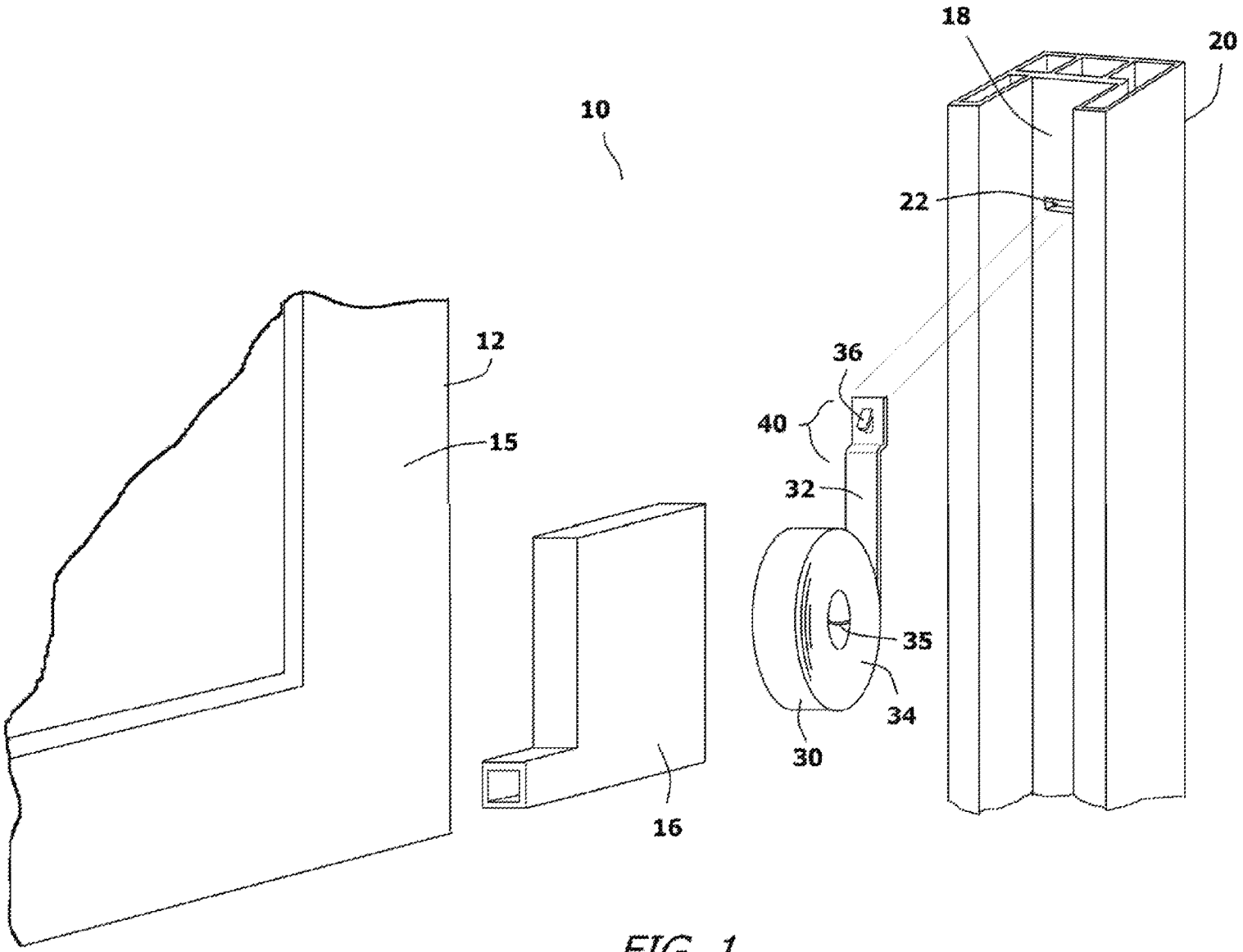
FIG. 1 is a fragmented perspective view of an exemplary embodiment of a counterbalance system for a window.

Referring to FIG. 1, the counterbalance system 10 for a window sash 12 of a window assembly 11 is shown. The window sash 12 has a sash frame 15 that selectively engages a spring carriage 16. In the shown embodiment, the spring carriage 16 holds a single counterbalance spring 30. It will be understood that the spring carriage 16 can be configured to hold multiple counterbalance springs. A spring carriage 16 with a capacity of one spring coil 30 has been selected for the sake of clarity. It will also be understood that the spring carriage 16 can be any prior art spring carriage and/or brake shoe assembly that is designed to hold the coil of a counterbalance spring.

The spring carriage 16 rides in a guide track 18 that is formed in the window frame 20 on the sides of the window sash 12. The guide track 18 often has an extruded plastic construction, and such a construction is shown. Mounting slots 22 are formed in the guide track 18 at the points where a counterbalance spring 30 is to be connected to the window frame 20. The mounting slots 22 each have a width that is just slightly wider than the steel ribbon 32 used to create the coil spring 30. Furthermore, each mounting slot 22 has a height that is slightly larger than the gauge of steel used in the steel ribbon 32.

The counterbalance spring 30 is a wound ribbon spring that is biased into a coil 34. Accordingly, the counterbalance spring 30 resists being unwound from the coil 34. A counterbalance spring 30 is made from a steel ribbon 32 that has two ends 35, 36. When the steel ribbon 32 is wound into the shape of the counterbalance spring 30, its first end 35 is located on the interior of the coil 34. The second end 36 of the steel ribbon 32 terminates on the exterior of the coil 34.

The steel ribbon 32 approaching the second end 36 is formed into an anchor configuration 40. The anchor configuration 40 is specifically configured to mechanically engage a mounting slot 22 in the guide track 18, as will later be explained in detail.

Figure 2:
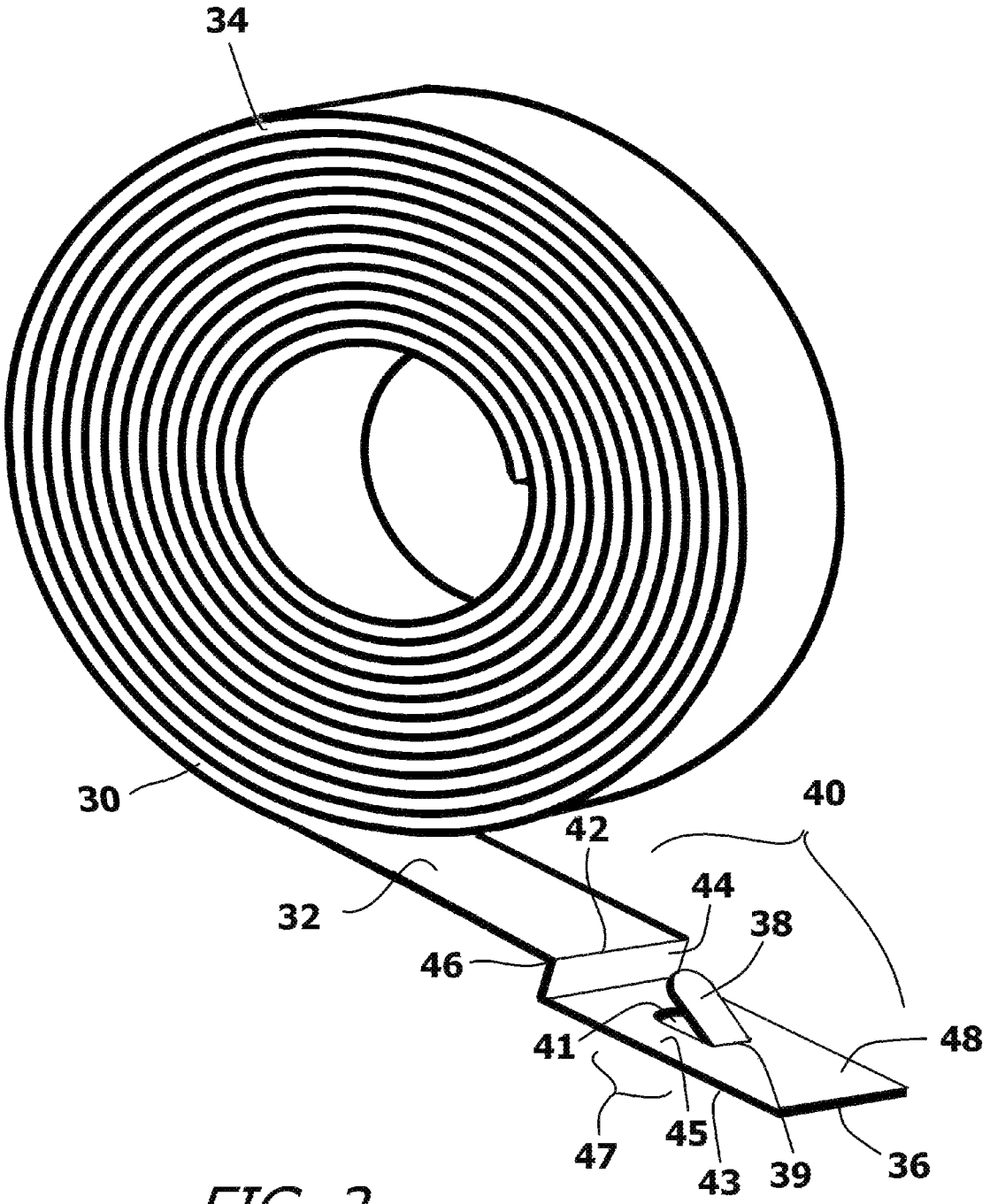
FIG. 2 is an enlarged perspective view of a coil spring used within the counterbalance system.

Referring to FIG. 2 in conjunction with FIG. 1, it can be seen that the anchor configuration 40 begins when the steel ribbon 32 that extends from the coil 34 reaches a first bend 42. At the first bend 42, the direction of the steel ribbon 32 changes by a first angle, which is 90 degrees±15 degrees. Accordingly, after the first bend 42, the steel ribbon 32 generally extends away from the center of the coil 34.

The steel ribbon 32 extends through a short lateral section 44 as it progresses between the first bend 42 and a second bend 46. The lateral section 44 has a length L1. At the second bend 46, the direction of the steel ribbon 32 changes by a second angle, which is 90 degrees±15 degrees back into its original orientation. This creates an offset tab 48 that extends from the second bend 46 to the second end 36 of the steel ribbon 32. The offset tab 48 has a length L2, the significance of which is later explained.

A barb flap 38 is formed at, or near, the center of the offset tab 48. The barb flap 38 is created by a cut in the steel ribbon 32 that defines the profile of the barb flap 38. However, the barb flap 38 has one fixed edge 39 that remains part of the steel ribbon 32, therein retaining the barb flap 38 as part of the steel ribbon 32. The fixed edge 39 is positioned on the barb flap 38 closest to the second end 36 of the steel ribbon 32. The barb flap 38 is slightly bent along the fixed edge 39. This causes the barb flap 38 to protrude as an angled barb from the offset tab 48.

The angle of the barb flap 38 creates an opening 41 in the offset tab 48. The opening 41 is positioned in the center of the offset tab 48 at a point equidistant from the two parallel side edges 43 of the steel ribbon 32. The opening 41 in the offset tab 48 creates thinned sections 45 of the steel ribbon 32 on either side of the opening 41. The thinned sections 45 extend from the opening 41 to the side edges 43 of the steel ribbon 32. Being thinner than any other section of the steel ribbon 32 along the offset tab 48, the thinned sections 45 create an area 47 along the offset tab 48 that is more flexible than the other areas of the offset tab 48. It is, therefore, easier for the offset tab 48 to bend in the flexible area 47 than in any other area along the offset tab 48.

Figure 3:
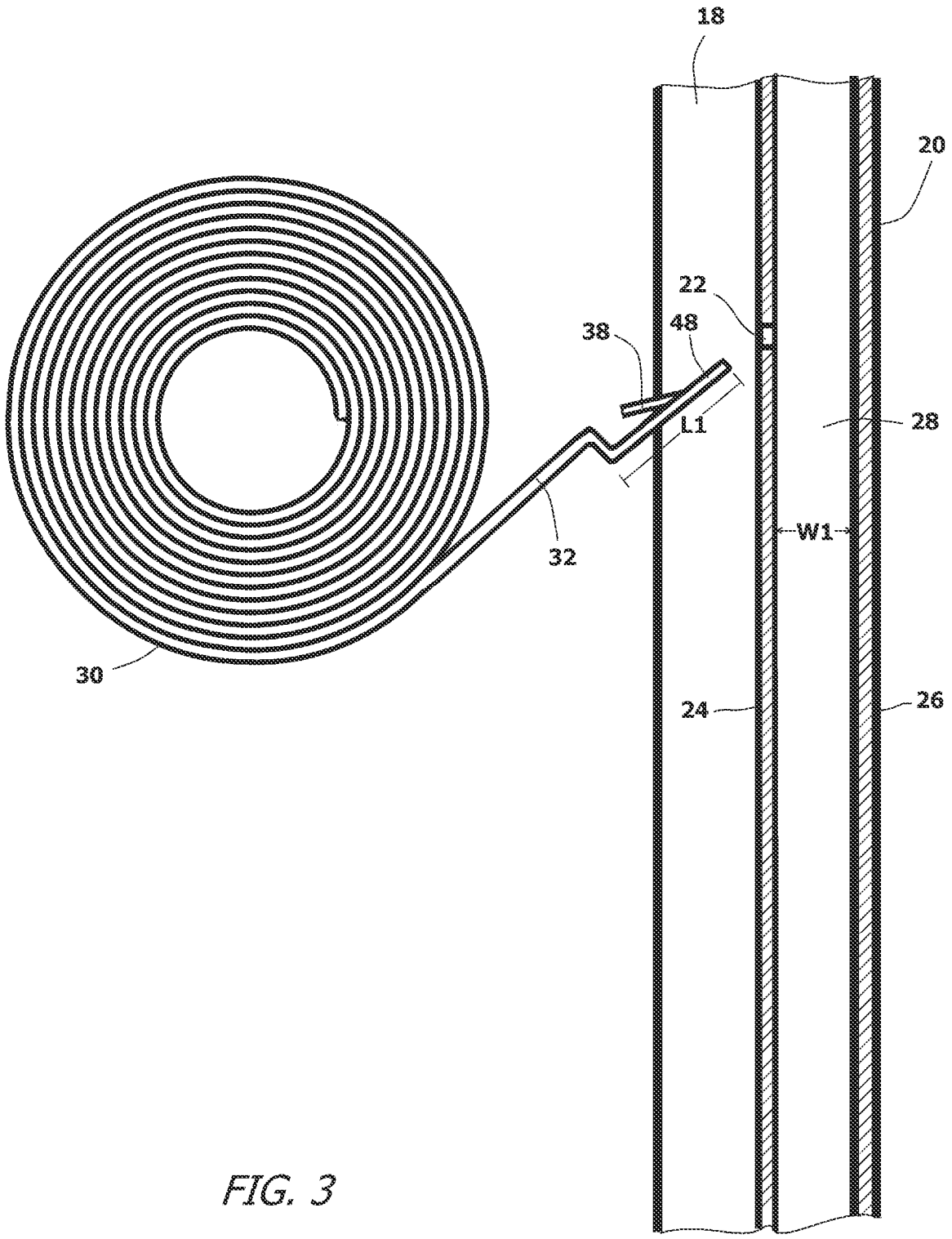
FIG. 3 is a side view of a coil spring and a selectively cross-sectional view of a segment of a guide track containing a mounting slot.

Referring to FIG. 3 in conjunction with FIG. 1 and FIG. 2, it can be seen that the guide track 18 is preferably an extruded component. When a guide track 18 of a window frame is manufactured, the guide track 18 is typically extruded with a series of parallel walls that are separated by gap spaces. This maximizes the strength of the guide track 18 while simultaneously minimizing the amount of material needed to form the guide track 18. The result is that the guide track 18 has an exterior wall 24 that faces the window sash 12, and an interior wall 26 that is parallel to the exterior wall 24. The exterior wall 24 and the interior wall 26 are separated by a gap space 28 having a width W1. The mounting slot 22 is formed in the exterior wall 24 of the guide track 18, therein providing access to the gap space 28 between the exterior wall 24 and the interior wall 26.

Figure 4:
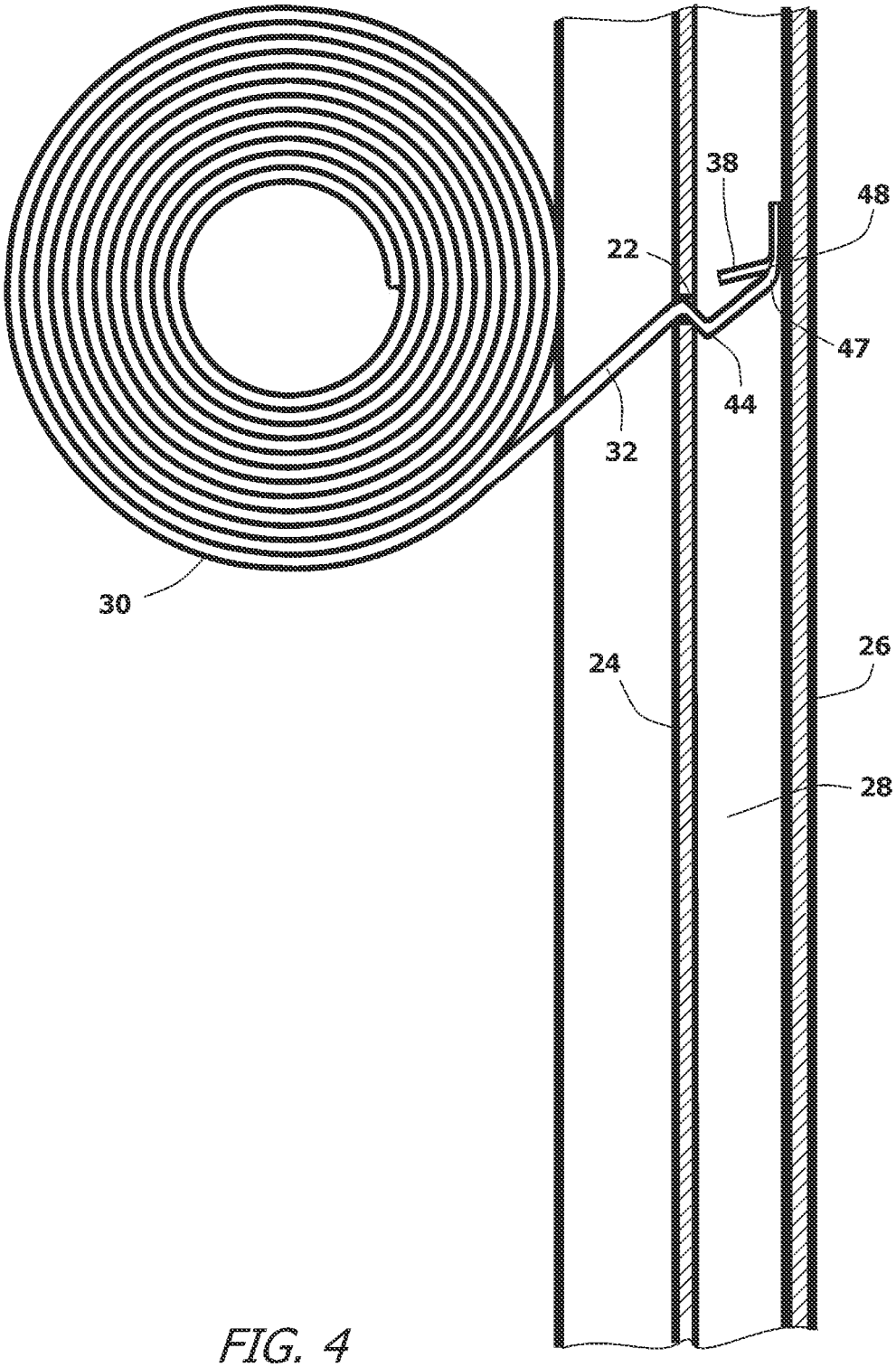
FIG. 4 shows the same matter as FIG. 3 with the coil spring partially engaging the mounting slot.
Figure 5:
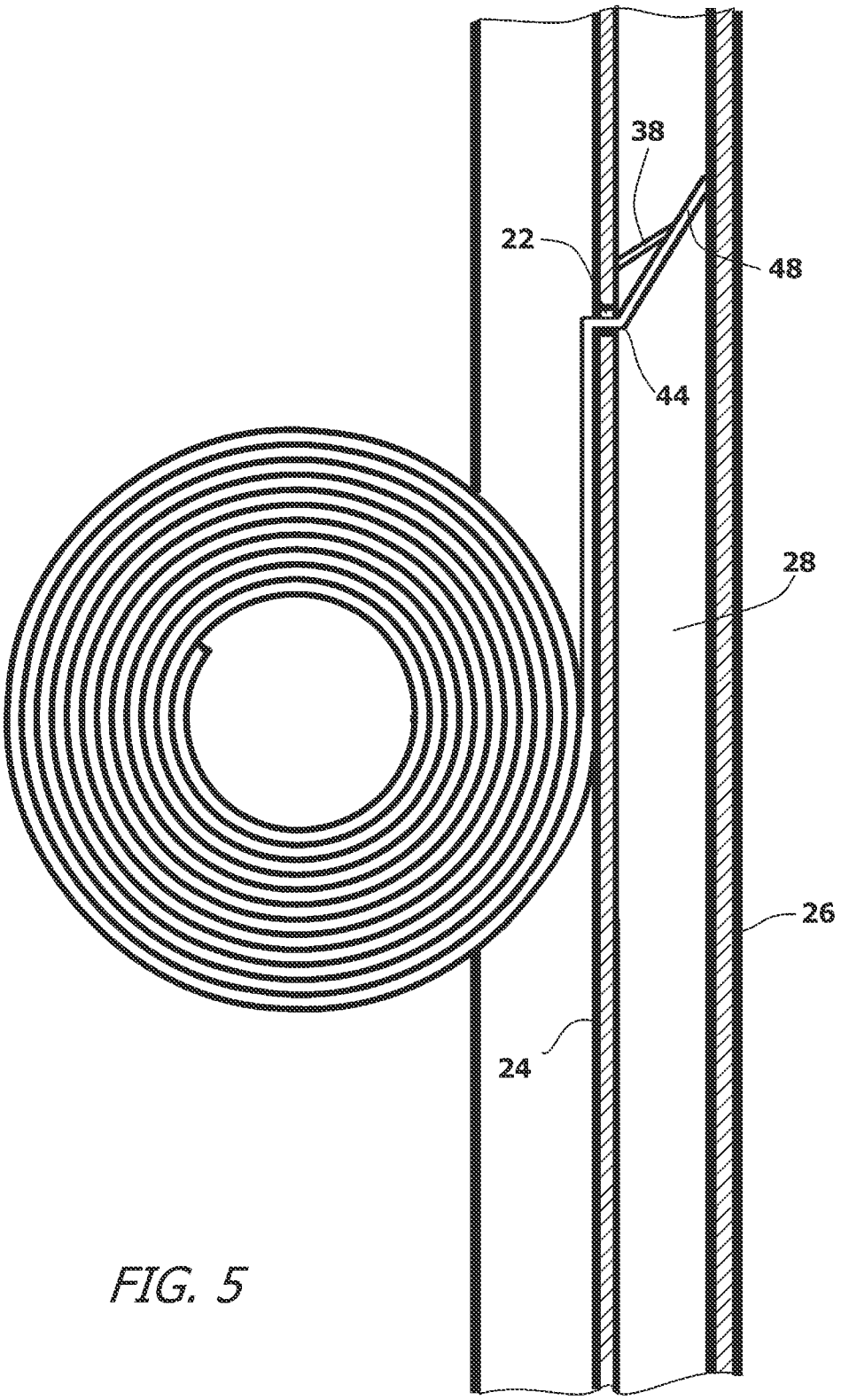
FIG. 5 shows the same matter as FIG. 4 with the coil spring fully engaging the mounting slot.

Referring to FIG. 3, FIG. 4, and FIG. 5, it can be seen that the length L1 of the offset tab 48 is at least twenty-five percent longer than the width W1 of the gap space 28 between the exterior wall 24 and the interior wall 26 of the guide track 18. The offset tab 48 is inserted into the mounting slot 22. The barb flap 38 extending from the offset tab 48 is angled away from the second end 36 to the steel ribbon 32. As such, the barb flap 38 is oriented to pass through the mounting slot 22 without binding on the exterior wall 24 during the insertion process. The flexible areas 47 on the sides of the barb flap 38 also enable the offset tab 48 to flex during the insertion process. The flexing helps the barb flap 38 to pass through the mounting slot 22 and prevent the second end 36 of the steel ribbon 32 from binding against the interior wall 26. Since the length of the offset tab 48 is longer than the width of the gap space 28, the offset tab 48 contacts the interior wall 26 at the opposite side of the gap space 28 during the insertion process. The offset tab 48 flexes as it is deflected by the interior wall 26. This enables the offset tab 48 to continue to pass into the gap space 28 until the lateral section 44 of the anchor configuration 40 reaches the mounting slot 22.

As the lateral section 44 of the anchor configuration 40 reaches the mounting slot 22, the lateral section 44 passes into the mounting slot 22. The mounting slot 22 is formed through the exterior wall 24 of the guide track 18. The exterior wall 24 of the guide track 18 is made from extruded plastic and has a thickness that is typically about $1/8^{th}$ of an inch. The lateral section 44 of the anchor configuration 40 has a length that is just slightly larger than the thickness of the exterior wall 24 of the guide track 18. As a consequence, the lateral section 44 of the anchor configuration 40 in the mounting slot 22 serves as a pivot fulcrum. Within the gap space 28, the offset tab 48 pivots until the offset tab 48 contacts the interior wall 26 and the barb flap 38 contacts the exterior wall 24. The offset tab 48 is caused to bend by the narrowness of the gap space 28. This bend biases the barb flap 38 against the exterior wall 24. In this orientation, the presence of the barb flap 38 and the dual contact points prevents the offset tab 48 from exiting the mounting slot 22. The anchor configuration 40 is, therefore, mechanically interlocked with the mounting slot 22 and cannot be unintentionally withdrawn.

As the counterbalance spring 30 is pulled downward by the movement of the window sash, the counterbalance spring 30 begins to unwind along the outside surface of the exterior wall 24. The sections of the counterbalance spring 30 that unwind from the coil 34 are biased against the outside surface of the exterior wall 24 of the guide track 18. The steel ribbon 32, therefore, remains pressed against the guide track 18 and out of sight as the counterbalance spring 30 moves up and down while winding and unwinding.

The anchor configuration 40 can be inserted into the mounting slot 22 by a simple manipulation of the counterbalance spring 30. This manipulation can be easily automated for manufacture. Furthermore, the counterbalance spring 30 need not be partially unwound in order to connect the counterbalance spring 30 to the guide track 18. Lastly, the mechanical interconnection between the anchor configuration 40 and the mounting slot 22 does not require the use of mechanical fasteners, such as screws or locking pins. It will therefore be understood that the anchor configuration 40 of the counterbalance spring 30 can be connected to a guide track 18 in a window frame in a highly cost effective and labor efficient manner.

Figure 6:
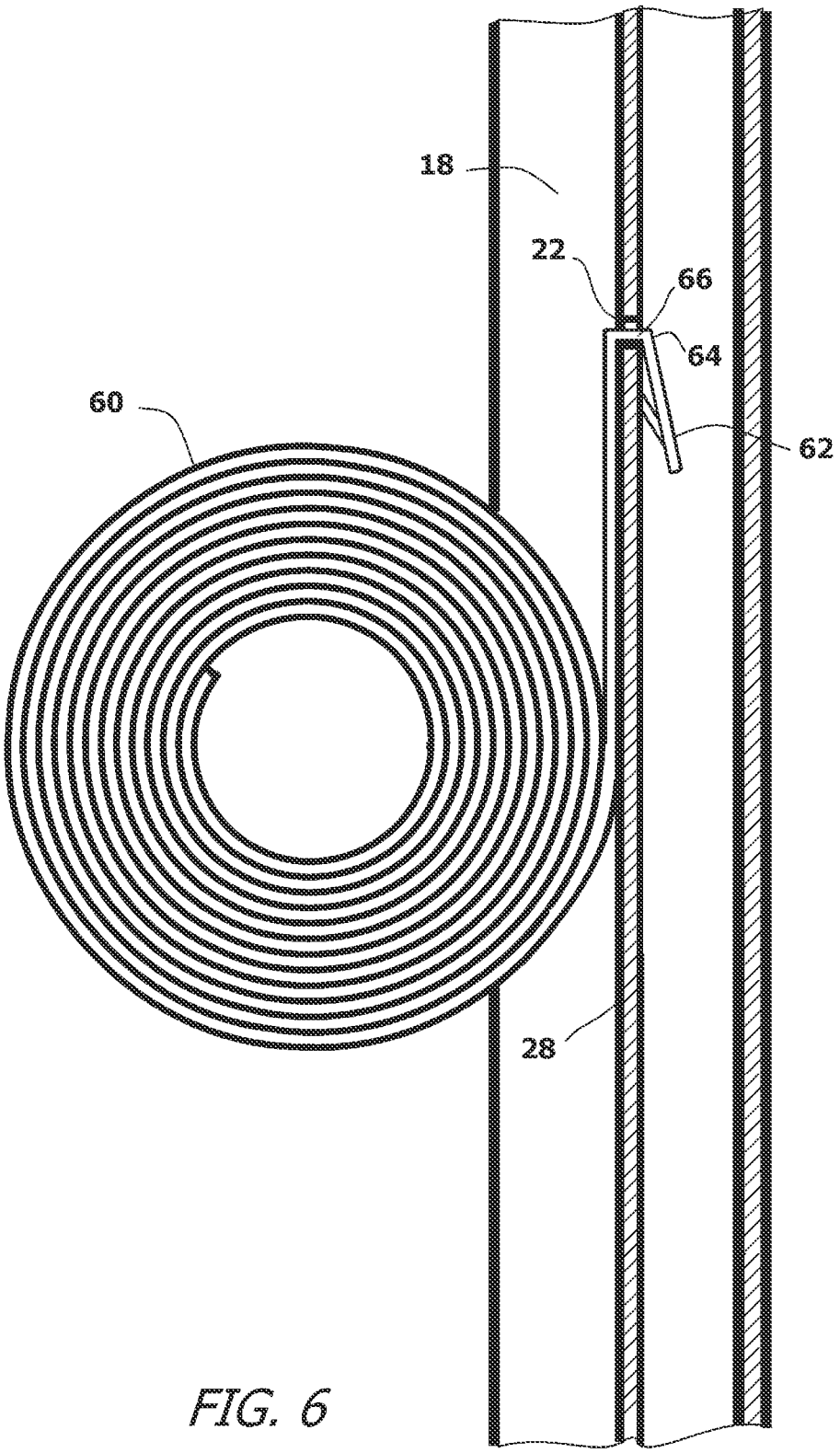
FIG. 6 shows an alternate embodiment of a coil spring and a selectively cross-sectional view of a segment of a guide track containing a mounting slot.

Referring to FIG. 6, an alternate embodiment of a counterbalance spring 60 is shown. In this embodiment, the counterbalance spring 60 has the same configuration as the counterbalance spring previously shown, except that the offset tab 62 is bent in the opposite direction at the second bend 64. As a result, the slot anchor configuration 66 is provided with a hooked shape.

When inserted into a mounting slot 22, it will be understood that the offset tab 62 of the slot anchor configuration 66 will pass through the mounting slot 22. The offset tab 62 then extends downwardly and presses against the interior wall 26 of the guide track 18.

It will be understood that the embodiments of the present invention are merely exemplary and that a person skilled in the art can make many variations to those embodiments. For instance, the length of the offset tab can be varied and the curvature of the offset tab can be varied. The first and second bends can be more or less than ninety degrees. All such variations, modifications, and alternate embodiments are intended to be included within the scope of the present invention as defined by the claims.

What is claimed is:

1. A system comprising:

a window frame having a first wall and a second wall that are separated by a gap space, wherein a guide track is defined in part by said first wall, said first wall having a first surface that faces said guide track and an opposite second surface that faces said gap space, wherein said gap space has a first width between said first wall and said second wall;

a mounting slot formed in said first wall;

a ribbon spring wound into a coil, said ribbon spring terminating with a free end, wherein said ribbon spring is bent into an anchor configuration proximate said free end, wherein said anchor configuration includes a first bend in said ribbon spring and a second bend in said ribbon spring that define a lateral section of said ribbon spring therebetween, and an offset tab section that extends from said second bend to said free end, said offset section having a first length that is longer than said first width of said gap space; and a barb flap bent from said offset tab section and extending from said offset tab section at an angle;

said coil being positioned on one side of said first wall and both said offset tab section and said barb flap being positioned in said gap space, therein positioning said lateral section of said ribbon spring within said mounting slot, wherein said offset tab section bends to fit in said gap space and biases said barb flap against said opposite second surface of said first wall within said gap space.

2. The system according to claim 1, wherein said offset tab section has a flexible segment and said offset tab section bends in a flexible segment within said gap space.

3. The system according to claim 2, wherein said barb flap is created by a cut in said offset tab section, wherein said cut also creates said flexible segment of said offset tab section.

4. The system according to claim 1, wherein said first length of said offset tab section is at least twenty-five percent longer than said first width of said gap space.

5. The system according to claim 1, wherein said first bend is 90 degrees±15 degrees.

6. The system according to claim 5, wherein said second bend is 90 degrees±15 degrees.

7. A system comprising:

an extruded window frame having an exterior wall, an interior wall, and a gap space separating said exterior wall from said interior wall, wherein said gap space has a first width;

a mounting slot formed in said exterior wall to provide access to said gap space;

a counterbalance spring terminating with a free end, wherein said counterbalance spring is bent into an anchor configuration proximate said free end, wherein said anchor configuration includes a lateral section between two bends and an offset tab section that extends from said lateral section to said free end, wherein said offset tab section has a first length that is longer than said first width;

a barb flap extending from said offset tab section at an angle, wherein said lateral section of said counterbalance spring extends through said mounting slot and wherein said offset tab section bends to fit in said gap space causing said barb flap to be biased against said exterior wall within said gap space.

8. The system according to claim 7, wherein said offset tab section has a flexible segment, and said offset tab section bends in said flexible segment within said gap space.

9. The system according to claim 8, wherein said barb flap is created by a cut in said offset tab section, wherein said cut also creates said flexible segment of said offset tab section.

10. The system according to claim 7, wherein said first length of said offset tab section is at least twenty-five percent longer than said width of said gap space.

11. The system according to claim 7, wherein each of said bends in said anchor configuration is 90 degrees±15 degrees.

12. The systems according to claim 11, wherein each of said bends in said anchor configuration bends in an opposite direction.

13. The system according to claim 11, wherein each of said bends in said anchor configuration bends in a common direction.

* * * * *